US007785087B2

(12) United States Patent
Schneider

(10) Patent No.: US 7,785,087 B2
(45) Date of Patent: Aug. 31, 2010

(54) VANE CELL PUMP HAVING PISTONS GUIDED IN CYLINDER FOR ADJUSTMENT OF THE STATOR

(75) Inventor: Willi Schneider, Bodelshausen (DE)

(73) Assignee: Joma-Hydromechanic GmbH, Bodelshausen (DE)

( * ) Notice: Subject to any disclaimer, the term of this patent is extended or adjusted under 35 U.S.C. 154(b) by 0 days.

(21) Appl. No.: 11/845,470

(22) Filed: Aug. 27, 2007

(65) Prior Publication Data

US 2008/0014108 A1 Jan. 17, 2008

Related U.S. Application Data

(63) Continuation of application No. PCT/EP2006/007944, filed on Aug. 11, 2006.

(30) Foreign Application Priority Data

Oct. 6, 2005 (DE) ..... 10 2005 048 602
May 3, 2006 (DE) ..... 10 2006 021 971

(51) Int. Cl.
*F04C 2/00* (2006.01)
*F04C 14/18* (2006.01)

(52) U.S. Cl. ..... 418/26; 418/27; 418/30; 417/220

(58) Field of Classification Search ..... 418/26, 418/27, 30, 31, 259, 266, 104, 145
See application file for complete search history.

(56) References Cited

U.S. PATENT DOCUMENTS 2,250,947 A 7/1941 Carpenter, Jr.
3,223,046 A 12/1965 Eickmann
3,687,579 A * 8/1972 Martin et al. ..... 418/26
5,752,815 A * 5/1998 Muller ..... 418/26
6,722,856 B2 4/2004 Schneider

FOREIGN PATENT DOCUMENTS

DE 195 04 220 A1 8/1996
DE 195 32 703 C1 11/1996
DE 196 31 974 A1 2/1998
DE 100 40 711 A1 3/2002
EP 0 049 838 A 4/1982
JP 59147890 A * 8/1984 ..... 418/26
WO WO 2007/039013 A1 4/2007

OTHER PUBLICATIONS

International Search Report.

* cited by examiner

*Primary Examiner*—Theresa Trieu
(74) *Attorney, Agent, or Firm*—Brinks Hofer Gilson & Lione

(57) ABSTRACT

The present disclosure relates to a vane cell pump (12) which includes an internal rotor (16) and a plurality of vanes (20) which are displacably mounted in a radial manner in the internal rotor, essentially, in radial slots (18) and are directly or indirectly guided on the internal circumferential surface (26) of a stator (28). The axis of the stator and the axis of the internal rotor are offset in relation to each other and the stator (28) can be adjusted in relation to the internal rotor (16) in the radial direction and the offset can be altered. The stator (28) comprises a pivotable bearing (36) which is arranged in the housing of the vane cell pump. At least one piston section (42) protrudes from the stator, whereby the piston axis thereof (44) extends in the direction of the periphery to the pivotable bearing (36).

15 Claims, 5 Drawing Sheets

VANE CELL PUMP HAVING PISTONS GUIDED IN CYLINDER FOR ADJUSTMENT OF THE STATOR

CROSS-REFERENCE TO RELATED APPLICATIONS

Figure 1:
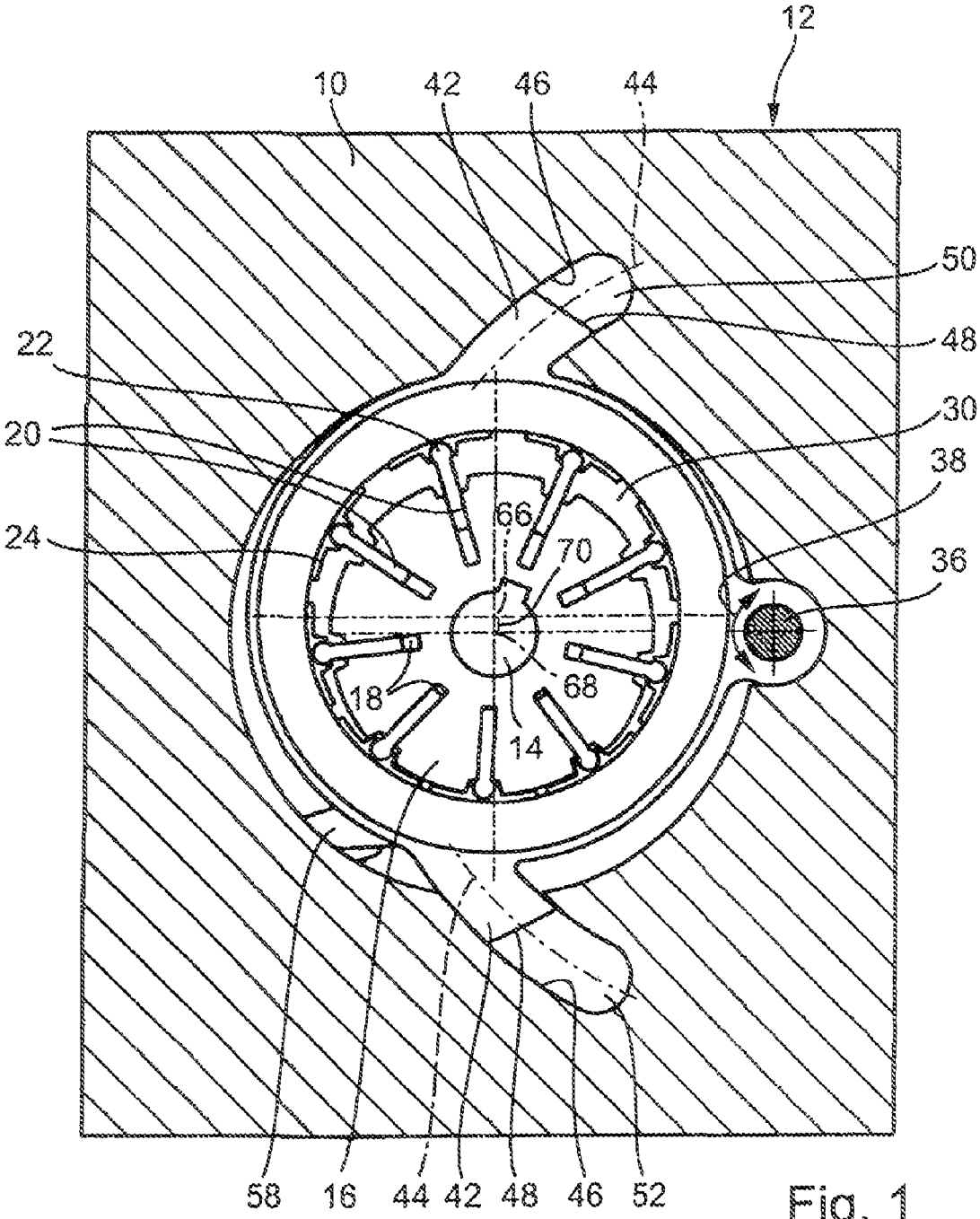

This application is a continuation of International Application No. PCT/EP2006/007944 filed on Aug. 11, 2006, which claims the benefit of German Patent Application No. 10 2005 048 602.9, filed Oct. 6, 2005 and German Patent Application No. 10 2006 021 971.6, filed May 3, 2006. The disclosures of the above applications are incorporated herein by reference.

FIELD

The present disclosure relates to vane cell pumps.

BACKGROUND

The statements in this section merely provide background information related to the present disclosure and may not constitute prior art.

From DE 100 40 711 A1, a vane cell pump with a ring-shaped inner rotor is known, in which a plurality of vane elements extending radially outward are located radially moveable. The internal radial end parts of the vane elements rest on a torque proof central part, and the external radial end parts on a torque proof outer ring. The rotor can be rotated around a rotation axis that is offset with respect to the central axis of the central element and outer ring. This way, on rotation of the rotor between the vane elements, conveyor cells are formed that enlarge and then reduce again. By changing the volume of the conveyor cells, fluid is suctioned into the conveyor cells and subsequently expelled. The end parts of the vane elements slide on the central element and outer ring, respectively. Such a vane cell pump is simple and inexpensive to construct.

In order to increase the degree of efficiency, a vane cell machine in the form of a pendulum slide valve pump is known from DE 195 32 703 C1. In this pump, the vane elements are located moveable in an inner rotor, whereas they are supported pivotable in a ring-shaped outer rotor. The rotation axis of the inner rotor is offset in relation to the rotation axis of the outer rotor, so that during operation, conveyor cells form that likewise enlarge and subsequently reduce. But the pendulum slide valve pump known from DE 195 32 703 C1 is complex, and therefore expensive to construct.

SUMMARY

In the vane cell pump according to the present disclosure, a piston or piston section is provided for the adjustment of the stator, which protrudes from the stator and whose piston axis runs in the circumferential direction of the pivot bearing. Thus, the piston moves around the pivot bearing in sections. The piston section has a defined piston area, which likewise rotates in the circumferential direction around the pivot bearing, with the advantage that the forces actuating on the stator are proportional to the compression forces acting on the piston area. This makes exact adjustments of the stator, and consequently of the output volume of the vane cell pump, possible, which are proportional to the pressure acting on the piston section. Thus, sensitive adjustment is possible.

A further development provides that the section of the piston and the stator are constructed in one piece. In particular, the piston section and stator are made of plastic or aluminum. This makes inexpensive manufacture of the vane cell pump possible, and mounting is simplified. Besides, compression as well as suction forces can act on the piston section.

In one variant, the piston section abuts loosely on the stator. This variant has the advantage that the piston section and the stator are made of different materials and that they are easy to mount.

In another variant, the piston section is attached to the stator, in particular screwed on. In this variant, the stator and piston section can also be made of different materials, and compression and suction forces can be transmitted.

A further development of the present disclosure provides that the stator is equipped with two piston sections. This way, when both piston sections are in opposite position to one another with respect to the axis of the stator, the stator can be adjusted in the direction of the maximum conveyance and in the direction of the minimum conveyance, wherefore control pressures act on the piston section.

As a result of this, very sensitive adjustment and/or positioning of the stator is accomplished, a feature that is required for parameter adjustment. In particular, when both piston sections are arranged inversely to one another on the stator, the smallest pressure variations may be taken into account in positioning the stator. Especially, there is no need to work against a spring constant, which has the disadvantage that operation has to take place against a changing spring force, i.e. against a spring constant. Incidental pressures may be used directly to displace the stator, namely in both directions.

Preferably, the cross-section of the piston is constructed rectangular. This embodiment has the advantage that the manufacture of the piston as well as the space to locate the piston section in the housing may be relatively easy to accomplish, since the section of the housing to locate the stator is plate-shaped, and the section merely has to be provided with an opening to locate the piston section, the sides being sealed with further plates (face plates).

Optimal guidance of the piston, and consequently of the stator in the housing, is accomplished in that a cylinder to locate the piston section is provided in the housing of the vane cell pump. This cylinder should not only form the piston space for the piston section, but also guide and support the stator, so that the pivot bearing only has to take up the forces occurring in the circumferential direction of the pivot bearing, but no traction or compression forces in the radial direction.

A further development of the present disclosure provides that the cylinder at least supports the piston section over part of its length on the inner and outer radial running surface. This way, a defined piston space acting on a defined piston area is created. Besides, the surfaces running parallel to the pivot axis serve as supporting surfaces for forces vertical to the pivot axis acting on the stator. This way, the pivot axis is relieved of load.

A further development of the present disclosure provides that an overflow duct is arranged on the outer perimeter of the stator that connects an exhaust duct on one side of the face side of the vane cell pump with an exhaust duct on the other side of face side the vane cell pump. This increases the efficiency of the vane cell pump because the conveyed medium can be evacuated more effectively, that is, with less loss of material.

The overflow duct runs axially parallel to the axis of the stator. This has the essential advantage that the overflow duct can be constructed in a relatively simple manner, and that the overflow duct can be connected to the outlet ducts in a relatively simple manner via arch-shaped flow ducts provided in lateral lids.

The overflow duct is preferably a part of the piston section. The piston section therefore has the double function of adjustment element for the stator in order to adjust it between maximum and minimum conveyance, and connection between both outlet ducts, which protrude from the internal space on both face sides of the stator.

An overflow duct is preferably provided between the stator and the housing of the machine, said overflow duct connecting the inlet duct on one face side of the vane cell pump with the inlet duct on the other front face of the vane cell pump. This overflow duct is formed by a free space that is required for the displacement of the stator in the housing.

The overflow ducts for the inlet duct as well as for the outlet duct have the advantage that fluid can flow into the vane cell pump from both face sides, which allows optimal filling of the working spaces. Moreover, the conveyed medium can rapidly flow off without losses because it can be evacuated from the working space through both face sides.

Another form of the present disclosure provides that a supporting element for a compression element protrudes from the stator. This supporting element is especially attached one-piece to the stator and serves to absorb the force of a compression spring, especially a helical spring. But it is also conceivable that the compression element is a flat spring or a pneumatic cushion. The compression element, which is pretensioned, is intended to adjust the stator in the direction of maximum conveyance of the pump. This is required when there is a failure of the pneumatic or hydraulic control via the piston section. Activation via the compression element ensures that the van cell pump continues operating and, on top of that, at maximum performance to feed the connected system with the medium to be conveyed.

Further advantages, characteristics and details of the present invention will be apparent from the following description and explained in more detail with reference to two especially preferred exemplary embodiments in the figures. The characteristics illustrated in the drawings as well as the features mentioned in the claims and description are employed in accordance with the teachings of the present disclousre as such or in any combination.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
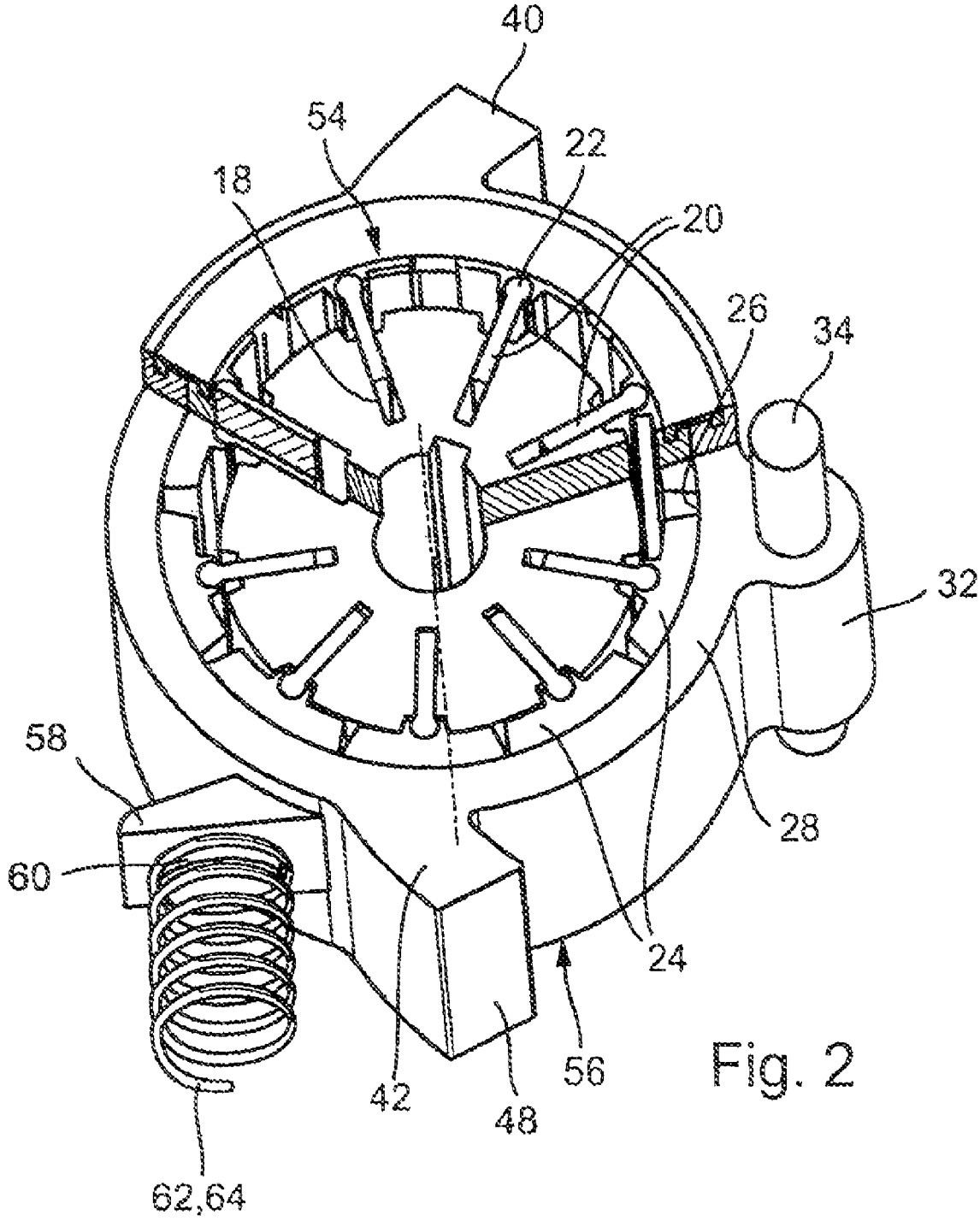
Figure 3:
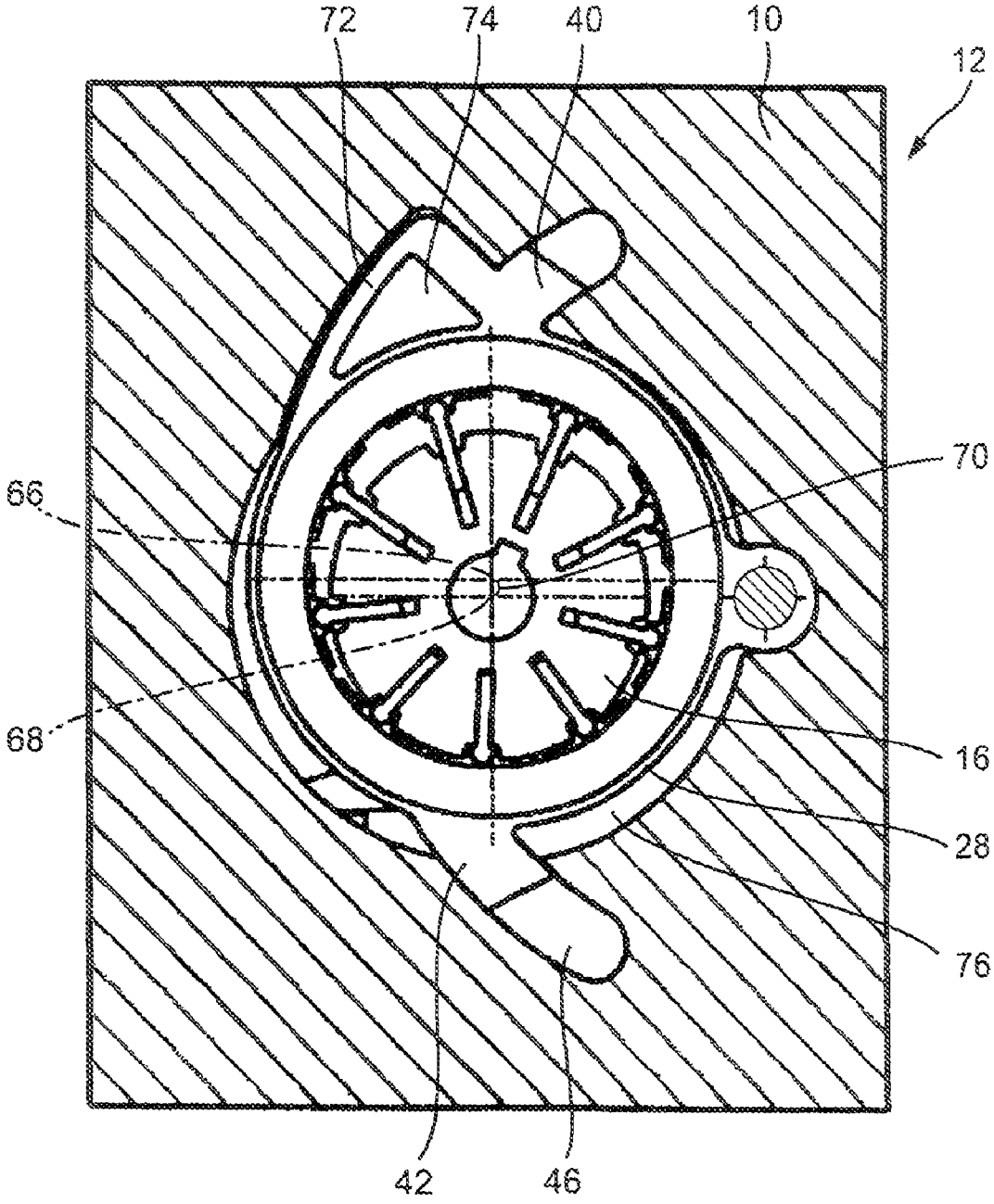
Figure 4:
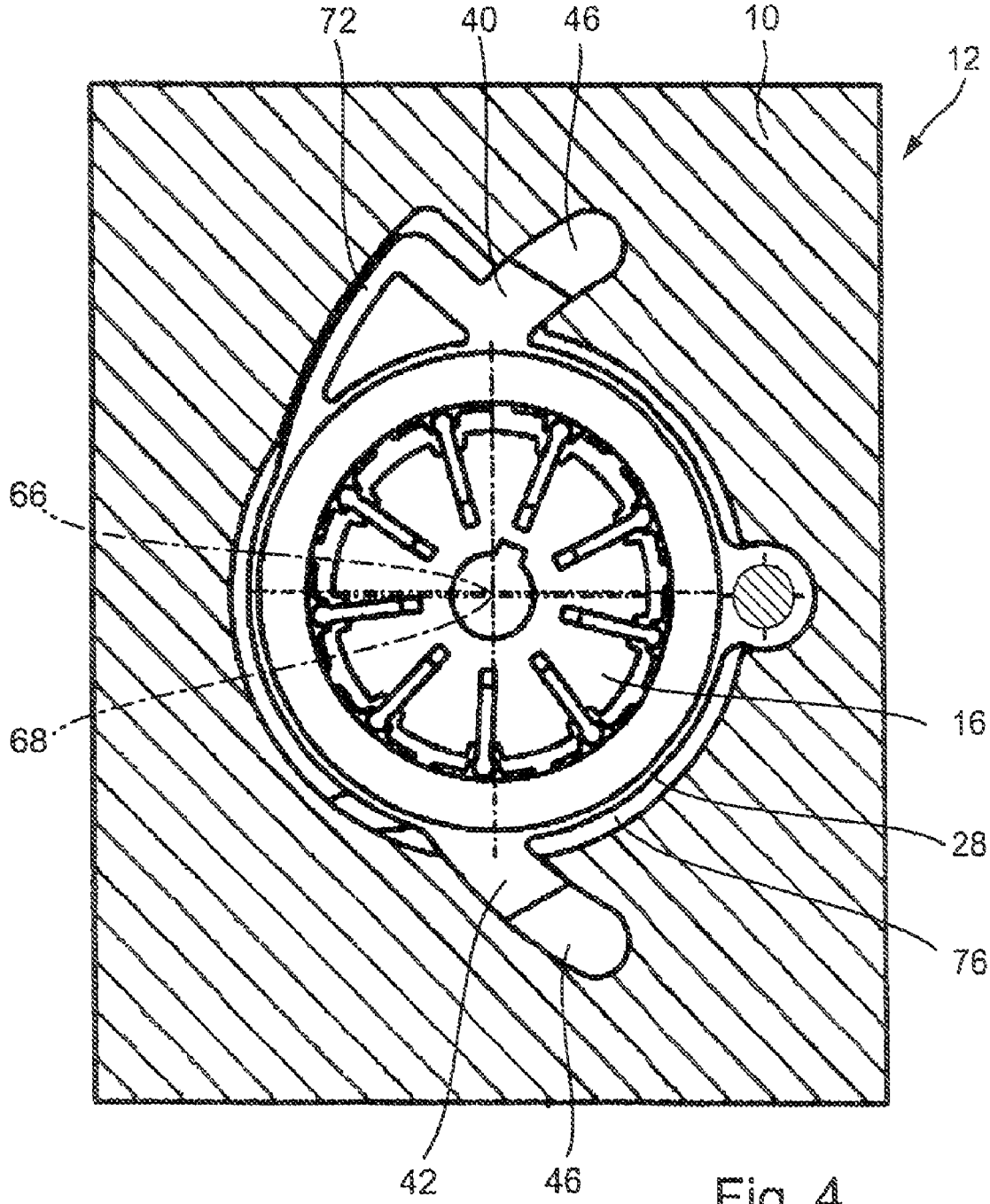
Figure 5:
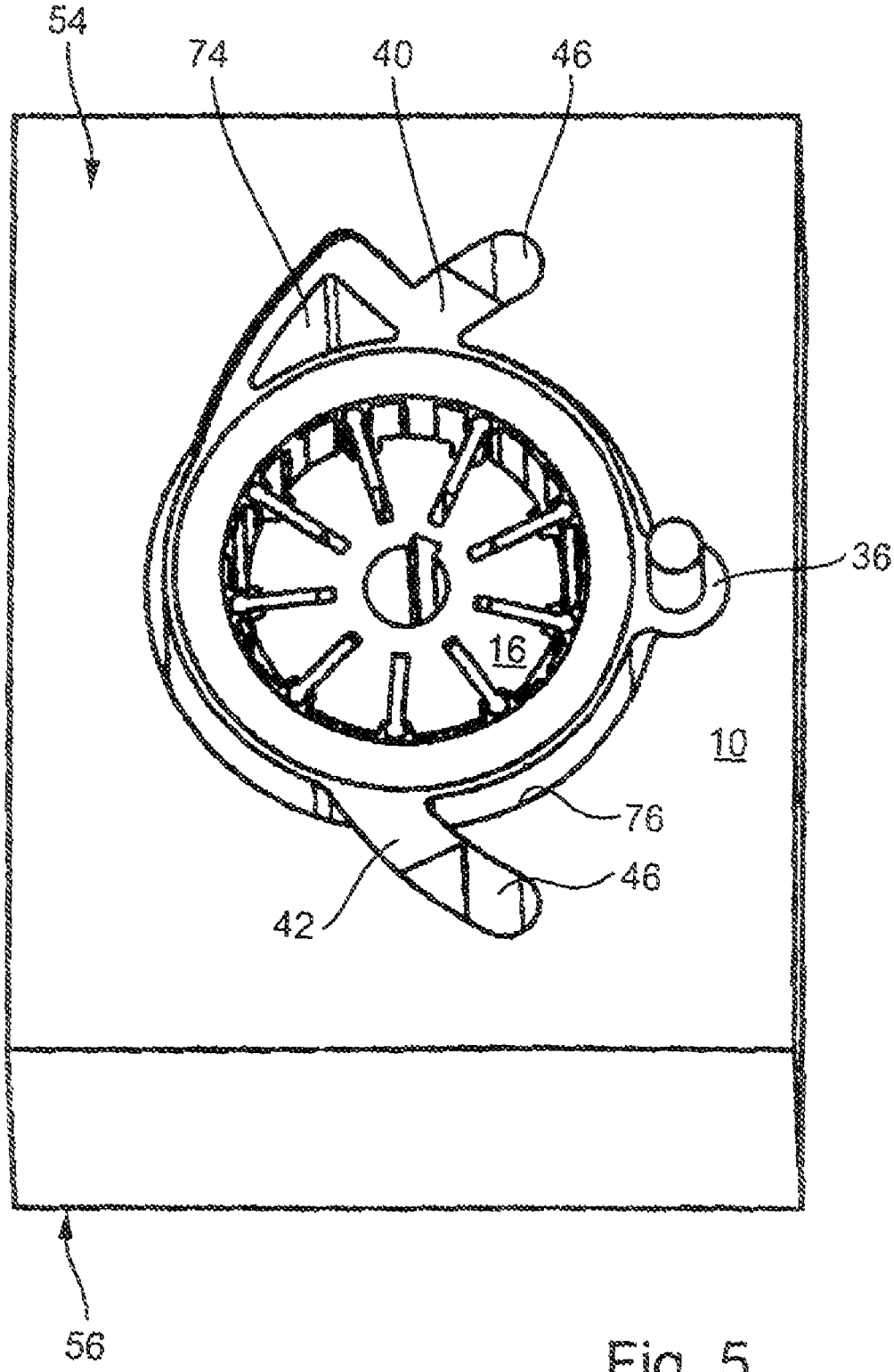

In order that the invention may be well understood, there will now be described an embodiment thereof, given by way of example, reference being made to the accompanying drawing, in which:

FIG. 1 a cross-section of a first embodiment of the vane cell pump according to the present invention;

FIG. 2 a perspective view of the stator with a partly sectioned view of the inserted rotor;

FIG. 3 a cross-section of a second embodiment of the vane cell pump according to the present invention showing the position of the inner rotor at maximum conveyance;

FIG. 4 a cross-section according to FIG. 3 showing the position of the inner rotor at minimum conveyance; and FIG. 5 a perspective illustration of the vane cell pump according to FIG. 3.

DETAILED DESCRIPTION

The following description is merely exemplary in nature and is not intended to limit the present disclosure, application, or uses.

For a better comprehension of the present invention, reference is made to DE 10 2005 048 602, the contents of which are incorporated herein by reference in their entirety.

FIG. 1 schematically shows a housing 10 of a vane cell pump designated as a whole with 12, in which a drive shaft 14 is mounted. This drive shaft 14 drives an inner rotor 16, which has a plurality of slots 18, in which vanes 20 are mounted radially displaceable. These vanes 20 have a thickened end 22, on which guiding block 24 are attached in a pivotable manner. The guiding block 24 rests on the internal circumferential surface 26 of a stator 28, as is apparent from FIG. 2. The inner rotor 16, two vanes 20, two guiding blocks 24 as well as the stator 28, respectively form a working space 30. The working space 30 enlarges and reduced when the inner rotor 16 rotates so that fluid may be conveyed.

Moreover, it is apparent from FIGS. 1 and 2 that the stator 28 has a bearing lug 32, which encompasses a pivot 34 forming a pivot bearing 36 firmly attached to the housing. Consequently, the stator 28 can be pivoted around the pivot bearing 36 inside the housing 10 in the direction of the double arrow 38. For this purpose, the stator 28 has to piston sections 40 and 42, which protrude from the external perimeter of the stator 28, and whose piston axes 44 extend around the pivot bearing 36 in the direction of the perimeter, i.e. concentrically toward it. The piston sections 40 and 42 are guided in a cylinder 46, respectively, which is provided in the housing 10 of the vane cell pump 12. The axis of the cylinder 46 likewise runs concentrically around the pivot bearing 36. The cylinder 46 rests on the internal and external radial tread surfaces of the pivot sections 40 and 42 over part of the length of the pivot sections 40 and 42. The piston sections 40 and 42 have a piston surface 48 each, which is pressurized, and exerts a pivot force around the pivot bearing 36 on the stator 28.

From FIGS. 1 and 2 it is clearly apparent that the stator 28 with its piston sections 40 and 42 is essentially constructed as a disc or plate, so that the piston sections 40 and 42 show rectangular cross-sections. The pressure chambers 50 and 52 are each sealed with disk-shaped or plate-shaped elements that are attached on the face sides 54 and 56 of the stator 28. Through this, the working spaces 30 are also closed on the face sides.

It is further apparent from FIG. 2 that a supporting element 58 protrudes from the stator 28, which has a centering nib for a compression element 62, for example a helical spring 64. The compression element 62 exerts a force on the stator 28 which causes the stator 28 to pivot clockwise around the pivot bearing 36. This way, the stator 28 is permanently pressed in the direction of maximum conveyance, so that the vane cell pump 12 takes its position for maximum conveyance in case of failure.

In FIGS. 3 and 5, which show a second exemplary embodiment of the vane cell pump 12 according to the present disclosure, the stator 28 is illustrated at maximum conveyance. FIG. 4 shows the minimum conveyance position, in which the axis 66 of the rotor 28 virtually has no offset 70 with respect to the axis 68 of the inner rotor 16. This offset 70, or eccentricity of the inner rotor 16, defines the output volume of the vane cell pump 12.

FIGS. 3 to 5 further show that an extension 72 is provided on the piston section 40, which basically has a triangular cross-section. This extension 72 has an overflow duct 74, which is illustrated clearly in FIG. 5, which connects both face sides 54 and 56 with one another. This way, the outlet ducts not illustrated in the drawings, which are provided on the cover plates attached on the face sides, and into which the conveyed medium flows from the working spaces 30, are connected with one another so that the working spaces 30 may be emptied via both face sides 54 and 56.

Moreover, it is apparent from FIGS. 4 and 5 that between the stator 28 and the housing 10 an overflow duct is provided, which surrounds the stator 28 and connects the inlet ducts provided on both face sides 54 and 56 with one another. Thus, the working spaces 30 can be filled from both face sides 54 and 56.

Both overflow ducts 74 and 76 serve to increase the efficiency of the vane cell pump 12, as the working spaces 30 can be filled and emptied more efficiently, thus reducing the losses.

FIG. 5 further shows that the housing 10 of the vane cell pump 12 is essentially disk-shaped and/or plate-shaped, and in which the locating space for the stator 28 and cylinder 46 are incorporated as perforations. Sealing on the face side is accomplished by attaching a plate on each side. The construction of this type of components is relatively simple, and mounted can be performed mechanically.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A vane cell pump with an inner rotor and a plurality of vanes, which are essentially mounted radially displaceable in radial slots in the inner rotor and are guided by one of directly and indirectly on the internal circumferential surface of a stator, an axis of the stator and an axis of the inner rotor being offset in relation to one another, and the stator being radially adjustable in relation to the inner rotor, and the offset being consequently modifiable, and the stator comprising a pivot bearing arranged in a housing of the vane cell pump, characterized in that at least one piston section protrudes from the stator, whose piston axis runs in the circumferential direction with respect to the pivot bearing at an intersection of the piston axis and a circumference of the stator, and the piston is guided in a cylinder provided in the housing, and when pressurized, exerts a pivot force on the stator.

2. The vane cell pump according to claim 1, characterized in that the piston section and the stator are constructed in one piece.

3. The vane cell pump according to claim 1, characterized in that the stator is equipped with two piston sections.

4. The vane cell pump according to claim 3, characterized in that both piston sections are opposite to one another in relation to the axis of the stator.

5. The vane cell pump according to claim 3, characterized in that both piston sections act in opposite directions.

6. The vane cell pump according to claim 1, characterized in that a cross-section of the piston section is rectangular.

7. The vane cell pump according to claim 1, characterized in that a cylinder is arranged in the housing of the vane cell pump to locate the piston section.

8. The vane cell pump according to claim 7, characterized in that the cylinder supports the piston section at least over part of its length in an internal and an external radial tread surface.

9. The vane cell pump according to claim 1, characterized in that an overflow duct (74) is provided on an external circumference of the stator (28), which connects an outlet duct on one face side (54) of the vane cell pump (12) with an outlet duct on the other face side (56) of the vane cell pump (12).

10. The vane cell pump according to claim 9, characterized in that the overflow duct (74) runs axially parallel to the axis (66) of the stator (28).

11. The vane cell pump according to claim 9, characterized in that the overflow duct (74) is part of the piston section (40).

12. The vane cell pump according to claim 1, characterized in that an overflow duct (76) is provided between the stator (28) and the housing (10), which connects an inlet duct on one face side (54) of the vane cell pump (12) with an inlet duct on the other face side (56) of the vane cell pump (12).

13. The vane cell pump according to claim 1, characterized in that a supporting element for a compression element protrudes from the stator.

14. The vane cell pump according to claim 13, characterized in that the supporting element and the stator are constructed in one piece.

15. The vane cell pump according to claim 13, characterized in that a compression spring meshes with the supporting element.

* * * * *